US011148068B2

(12) United States Patent
Niroumand

(10) Patent No.: US 11,148,068 B2
(45) Date of Patent: Oct. 19, 2021

(54) HURDLE ASSIST

(71) Applicant: Mahmoud Niroumand, Costa Mesa, CA (US)

(72) Inventor: Mahmoud Niroumand, Costa Mesa, CA (US)

( * ) Notice: Subject to any disclaimer, the term of this patent is extended or adjusted under 35 U.S.C. 154(b) by 293 days.

(21) Appl. No.: 16/577,018

(22) Filed: Sep. 20, 2019

(65) Prior Publication Data

US 2021/0086098 A1 Mar. 25, 2021

(51) Int. Cl.
*A63K 3/04* (2006.01)
*A63K 3/00* (2006.01)
*A63B 5/16* (2006.01)

(52) U.S. Cl.
CPC ..... *A63K 3/043* (2013.01); *A63B 5/16* (2013.01); *A63K 3/00* (2013.01)

(58) Field of Classification Search
CPC ..... A63B 5/16; A63K 3/00–046
USPC ..... 472/82–87
See application file for complete search history.

(56) References Cited

U.S. PATENT DOCUMENTS 3,061,306 A * 10/1962 Magill ..... A63K 3/043 482/17
3,985,353 A * 10/1976 Vosberg ..... A63K 3/043 482/16
D454,593 S * 3/2002 Kosir ..... A63K 3/043 D20/44
D487,115 S * 2/2004 Kosir ..... G09F 15/0037 D20/43
7,666,119 B1 * 2/2010 Jhang ..... A63K 3/043 482/23
D689,949 S * 9/2013 Valls ..... D20/43
8,857,087 B1 * 10/2014 Wildrick ..... G09F 3/204 40/661.03
2006/0037486 A1 * 2/2006 Kurmlavage ..... A47J 37/0786 99/538
2006/0075670 A1 * 4/2006 Brinkman ..... G09F 3/204 40/666
2009/0211135 A1 * 8/2009 Garfinkle ..... G09F 7/10 40/611.05
2009/0275008 A1 * 11/2009 Caruso ..... A63B 5/02 434/258
2014/0117179 A1 * 5/2014 Valls ..... G09F 3/16 248/213.2
2015/0348451 A1 * 12/2015 Garfinkle ..... G09F 15/0037 40/611.01
2018/0169454 A1 * 6/2018 Bowman ..... A63K 3/043

* cited by examiner

*Primary Examiner* — Andrew S Lo
(74) *Attorney, Agent, or Firm* — Michael M. Ahmadshahi

(57) ABSTRACT

A hurdle assist includes a flexible tubular lower section comprising a first length and a first slit along the first length, a flexible tubular upper section comprising a second length and a second slit along the second length, and a flexible rod which is slidably removably coupled with the flexible upper section. Attaching the hurdle assist to a hurdle mimics a flexible hurdle for the runner to practice without fear of injury.

8 Claims, 4 Drawing Sheets

HURDLE ASSIST

COPYRIGHT

A portion of the disclosure of this patent document contains material which is subject to copyright protection. The owner has no objection to the facsimile reproduction by anyone of the patent disclosure, as it appears in the Patent and Trademark Office files or records, but otherwise reserves all copyright rights whatsoever.

FIELD OF INVENTION

The present invention relates to a hurdle assist apparatus which includes a coupler and a rod. The coupler includes an upper section and a lower section, the latter may be removably coupled with a barrier section of a running hurdle. The rod may be slidably removably coupled with the upper section of the coupler so as to protrude outwardly away from a distal end of the barrier section.

BACKGROUND

Hurdlers must run over hurdles in a competition for which they often go through an extended period of training. The training involves the hurdler practicing with an actual hurdle. During practice, the hurdler often makes violent contact with the hurdle which causes severe injuries to the hurdler. It also causes the hurdler to detrimentally alter his/her routine. For instance, a beginner hurdler is afraid of running over the hurdle for fear of hitting, tripping, and getting injured by the hurdle. That is because the hurdles are made from rigid and inflexible materials.

A beginner hurdler may utilize the hurdle assist apparatus to eliminate the fear of hitting an actual hurdle. For instance, the hurdle assist apparatus may be used on two neighboring hurdles placed on two running lanes. The rod of one the two hurdle assists extends into a middle lane between the two aforementioned lanes, and the rod of the other hurdle assist extends into the same middle lane. As such three lanes will be used, but the center lane (the practice lane) will not have a physical hurdle in it. Attaching the hurdle assists on the neighboring hurdles creates a flexible hurdle (in the center lane) for the runner to practice with. Using the hurdle assists, enables the hurdler to practice without fear of injury.

Hurdle Assist can also be used for the more experienced hurdlers. Experienced hurdlers normally practice a variety of hurdle exercises for each leg. The hurdler's front leg is called the lead leg. The lead leg goes straight over the hurdle. The second leg/back leg is called the trail leg. The trail leg bends over the hurdle for quicker movement.

When the athlete practices with the trail leg, the body of the runner is away from the hurdle because the lead leg lands on the outside of the practice lane. When practicing with the trail leg, it is practical to use a real hurdle without getting injured. When practicing with the lead leg, there is danger of landing on the metal base of the subsequent hurdle and also the sharp, top corner part of the hurdle which can injure and scratch the hamstring.

With hurdle assist, there is no longer a metal base in front of the hurdler during lead leg practice drills. The hurdle assist is made of flexible material making training safer and more comfortable.

Speed during competition is critical to a hurdler's success. When a hurdler practices with a regular hurdle using the lead leg, sometimes, speed is lost because of a hurdler's fear of hitting hurdles. Practicing with the hurdle assist can train the hurdler to run fearlessly and with maximum speed.

Professional athletes can use the hurdle assist on top of the hurdle itself. Using two hurdle assists facing inward, the entire top of the hurdle will be covered. The hurdle assist will be positioned, like a bar, less than an inch on top of the regular hurdle. The professional athlete will try to touch the top of the hurdle assist with their hamstring as they go over the hurdle. Practicing with hurdle assist in this manner will reassure the athlete that he/she is running as close to the hurdle as possible. This training will help them save time during their runs so that they can reach the finish line in a shorter amount of time.

SUMMARY

In one aspect, a coupler is disclosed wherein the coupler comprises a flexible tubular lower section comprising a first length and a first slit along the first length and a flexible tubular upper section comprising a second length and a second slit along the second length.

Preferably, the flexible tubular lower section comprises one of a circular cross section and a rectangular cross-section.

Preferably, the flexible tubular upper section comprises one of a circular cross section and a rectangular cross-section.

Preferably, the first length is equal to the second length.

Preferably, at least one of the flexible tubular lower section and the flexible tubular upper section is made from plastic.

Preferably, the coupler further comprises a flexible rod, said flexible rod comprising a third length, wherein the flexible rod is slidably removably coupled with the flexible upper section.

Preferably, the flexible rod further comprises one or more indicators along the third length.

Preferably, the one or more indicators comprise one or more segments of the flexible rod painted with a different color than a color of the flexible rod.

In another aspect, a coupler for use with a running hurdle is disclosed wherein the running hurdle comprises a barrier section, said barrier section comprising a barrier length, said coupler comprising a flexible tubular lower section comprising a first length and a first slit along the first length and a flexible tubular upper section comprising a second length and a second slit along the second length wherein the flexible tubular lower section is removably coupled with the barrier section along one of a first distal end and a second distal end of the barrier section.

Preferably, the flexible tubular lower section comprises one of a circular cross section and a rectangular cross-section.

Preferably, the flexible tubular upper section comprises one of a circular cross section and a rectangular cross-section.

Preferably, the first length is equal to the second length.

Preferably, the coupler further comprises a flexible rod, said flexible rod comprising a third length, wherein the flexible rod is slidably removably coupled with the flexible upper section.

In another aspect, a running hurdle barrier section extender is disclosed wherein the extender comprises a flexible tubular lower section comprising a first length and a first slit along the first length and a flexible upper section comprising a second length, wherein the second length is greater than the first length, and wherein whenever the flexible tubular lower section is removably coupled with the barrier section along one of a first distal end and a second distal end of the barrier section, said barrier section is extended along the one of a first distal end and a second distal end of the barrier section by a distance equal to the second length minus the first length.

In another aspect, a running hurdle assist system is disclosed wherein the system comprises a running hurdle comprising a barrier section, said barrier section comprising a barrier length, a coupler comprising a flexible tubular lower section, said flexible tubular lower section comprising a first length and a first slit along the first length, and a flexible tubular upper section, said flexible tubular upper section comprising a second length and a second slit along the second length and a flexible rod comprising a third length, wherein the flexible tubular lower section is removably coupled with the barrier section along one of a first distal end and a second distal end of the barrier section and wherein the flexible rod is slidably removably coupled with the flexible upper section.

Preferably, the flexible tubular lower section comprises one of a circular cross section and a rectangular cross-section.

Preferably, the flexible tubular upper section comprises one of a circular cross section and a rectangular cross-section.

Preferably, the first length is equal to the second length.

Preferably, at least one of the flexible tubular lower section and the flexible tubular upper section is made from plastic.

In another aspect, a method of assisting a hurdler during practice is disclosed wherein the method comprises providing a running hurdle, said running hurdle comprising a harrier section, said barrier section comprising a barrier length, providing, a coupler, said coupler comprising a flexible tubular lower section, said flexible tubular lower section comprising a first length and a first slit along the first length, and a flexible tubular upper section, said flexible tubular upper section comprising a second length and a second slit along the second length, and providing a flexible rod, said flexible rod comprising a third length, wherein the flexible tubular lower section is removably coupled with the barrier section along one of a first distal end and a second distal end of the barrier section, and wherein the flexible rod is slidably removably coupled with the flexible upper section.

DETAILED DESCRIPTION OF THE PRESENTLY PREFERRED EMBODIMENTS

Figure 1B:
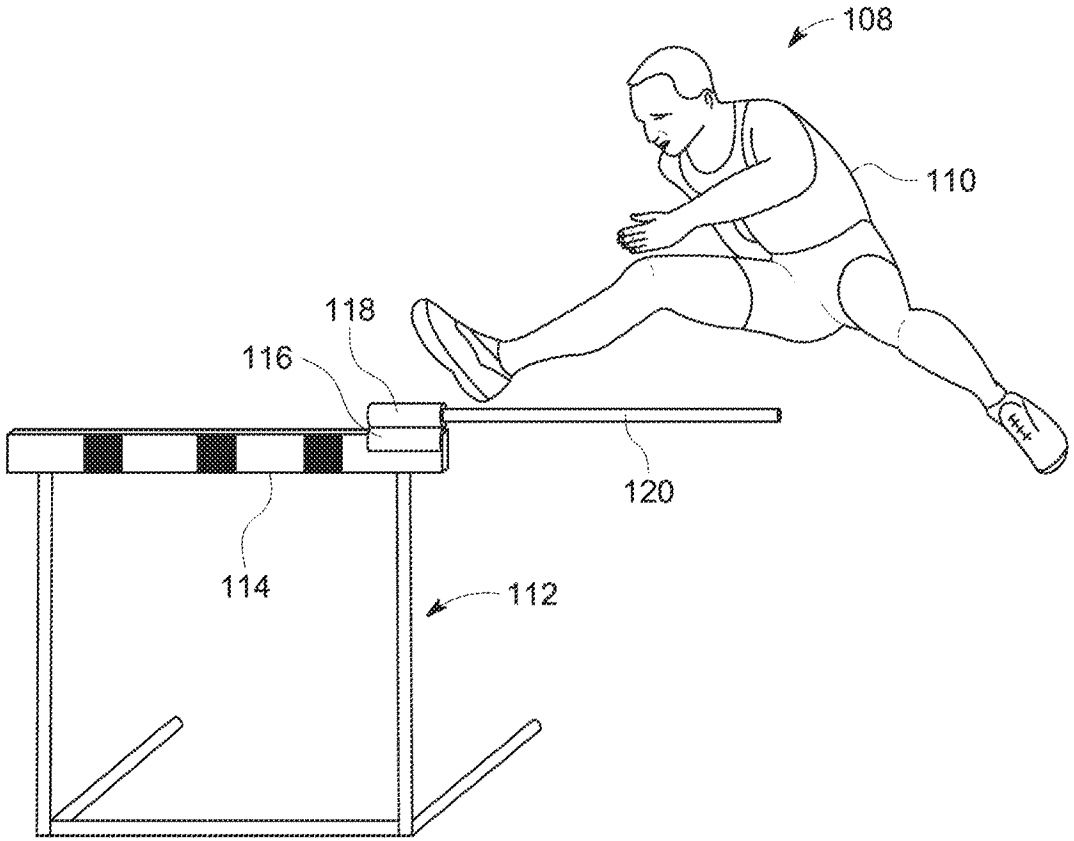
FIG. 1B shows a perspective view of a hurdler running over a hurdle that uses the hurdle assist according to a preferred embodiment.
Figure 1A:
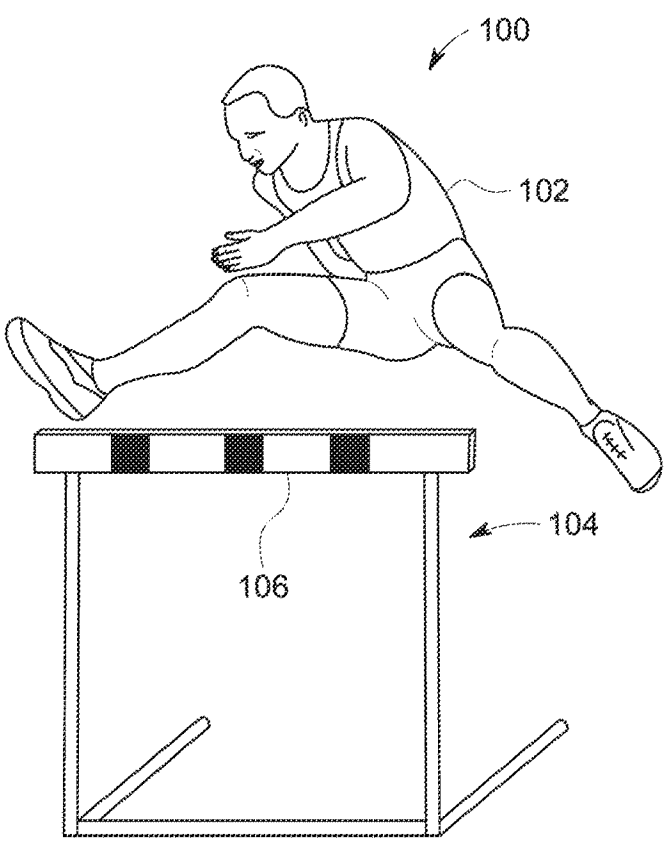
FIG. 1A (PRIOR ART)
FIG. 1A shows a perspective view of a hurdler running over a hurdle without the hurdle assist.

FIG. 1A depicts a perspective view 100 of a hurdler 102 running over a hurdle 104 comprising a barrier section 106. The hurdler 102 is tasked to run on a track that includes a number of hurdles, such as the hurdle 104, and run over the hurdles by raising his right foot to clear the barrier section 106 and then to raise his left foot behind his torso to clear the barrier section 106. According to prior art, the hurdler 102 uses the hurdle 104 during training. The hurdle 104 is made from rigid material and the hurdler 102 is fearful of making contact with the hurdle 104 causing the hurdler 102 to fall down or otherwise cause injuries.

FIG. 1B shows a perspective view of a hurdler 110 running over a hurdle 112 having a barrier section 114 that uses the hurdle assist which includes a coupler having a flexible tubular lower section 116 and a flexible tubular upper section 118, and a flexible rod 120. The flexible tubular lower section 116 is removably coupled with a distal end of the barrier section 114. The flexible tubular lower section 116 includes a slit (see for instance, FIGS. 2A and 2B) which can be easily connected to the distal end of the barrier section 114 without having to use fasteners such as bolts, screws, or adhesives. The flexible upper section 118 also includes a slit (see for instance, FIGS. 2A and 2B) which is used to easily insert the flexible rod 120 into the flexible tubular upper section 118. Utilizing the hurdle assist 116, 118, 120, the hurdler 110 can practice by running over the flexible rod 120, thereby, avoiding injuries that would otherwise result from running over and making contact with the barrier section 114 of the hurdle 112.

Figure 2A:
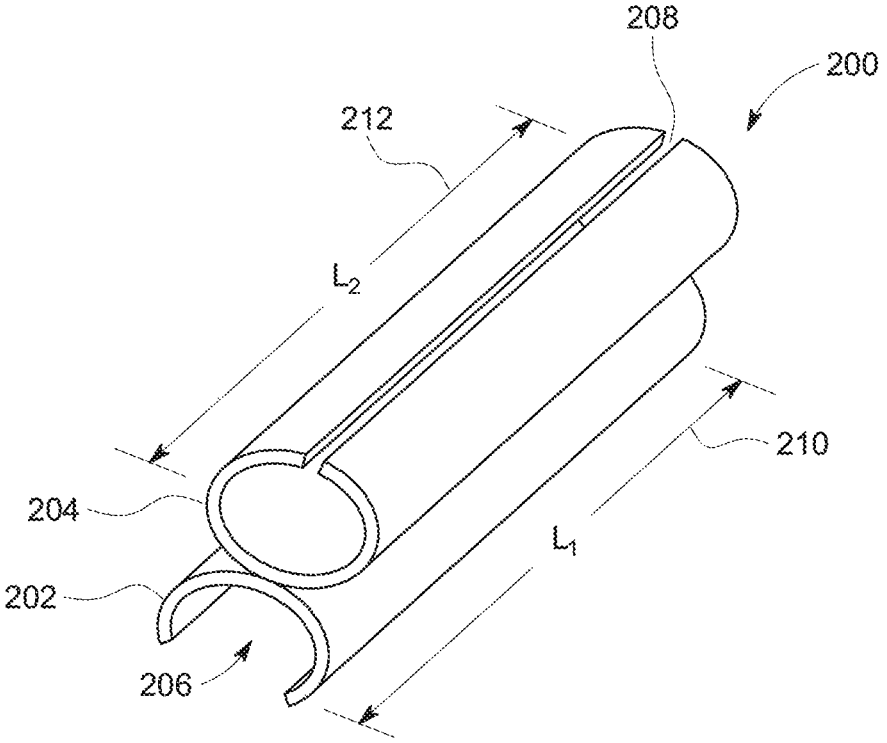
FIG. 2A shows a perspective view of a coupler having a flexible tubular lower section, and a flexible tubular upper section both having a circular cross section according to a preferred embodiment.

FIG. 2A shows a perspective view of a coupler 200 having a flexible tubular lower section 202 and a flexible tubular upper section 204. The flexible tubular lower section 202 has a length $L_1$ at 210 and the flexible tubular upper section 204 has a length $L_2$ at 210. According to this preferred embodiment, the length $L_1$ at 210 is equal to the length $L_2$ at 212, and is equal to 3 inches. According to this preferred embodiment, both the flexible tubular lower section 202 and the flexible tubular upper section 204 are of circular cross sections. In a preferred embodiment, an outer diameter of the flexible tubular lower section 202 is equal to 0.75 inches and an outer diameter of the flexible tubular upper section 204 is equal to 0.50 inches. In a preferred embodiment, both the flexible tubular lower section 202 and the flexible tubular upper section 204 are made from plastic material such as polyvinyl chloride, commonly known as PVC.

Figure 2B:
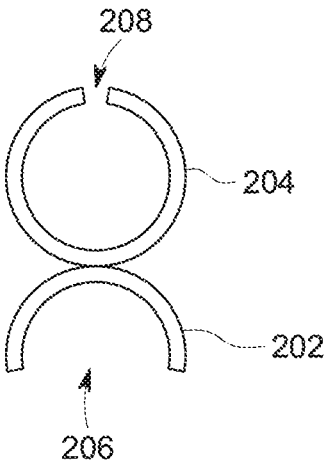
FIG. 2B shows a front view of the coupler shown in FIG. 2A.

FIG. 2B depicts a front view of the coupler 200 shown in FIG. 2A. The flexible tubular lower section 202 includes a slit 206 and the flexible tubular upper section 204 includes a slit 208. The slit 206 enables the flexible tubular lower section 202 to easily and removably couple with a barrier section of a hurdle, such as the barrier section 114 of the hurdle 112 shown in FIG. 1B. The slit 208 enables the flexible tubular upper section 204 to easily and slidably receive a rod, such as the flexible rod 120 shown in FIG. 1B. In a preferred embodiment, the slit 206 and the slit 208 are cut along the entire length of their respective flexible tubular lower section 202 and the flexible tubular upper section 204. In alternative embodiments, the slit 206 and the slit 208 are cut along a partial length of their respective flexible tubular lower section 202 and the flexible tubular upper section 204. In a preferred embodiment, the slit 206 is produced by removing 90 degrees of the circle, along the length $L_1$ at 210 of the flexible tubular lower section 202 and removing the 10 degrees of the circle, along the length $L_2$ at 212 of the flexible tubular upper section 204.

Figure 3:
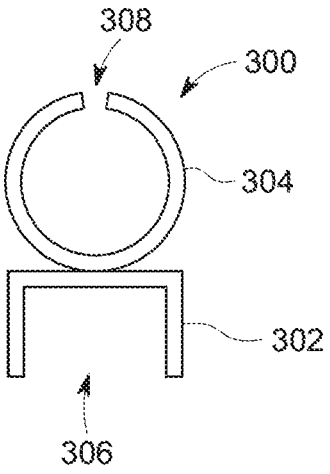
FIG. 3 shows a front view of a coupler having a flexible tubular lower section having a rectangular cross section and a flexible tubular upper section having a circular cross section according to a preferred embodiment.

In alternative embodiments, the cross sections of the flexible tubular lower section 202 and the flexible tubular upper section 204 may be of different profiles. FIG. 3 depicts a front view of a coupler 300 having a flexible tubular lower section 302 having a rectangular cross section and a flexible tubular upper section 304 having a circular cross section. The flexible tubular lower section 302 includes a slit 306 and the flexible tubular upper section 304 includes a slit 308. The slit 306 enables the flexible tubular lower section 302 to easily and removably couple with a barrier section of a hurdle, such as the barrier section 114 of the hurdle 112 shown in FIG. 1B, The slit 308 enables the flexible tubular upper section 304 to easily and slidably receive a rod, such as the flexible rod 120 shown in FIG. 1B. In, a preferred embodiment, the slit 306 and the slit 308 are cut along the entire length of their respective flexible tubular lower section 302 and the flexible tubular upper section 304. In alternative embodiments, the slit 306 and the slit 308 are cut along a partial length of their respective flexible tubular lower section 302 and, the flexible tubular upper section 304.

Figure 4:
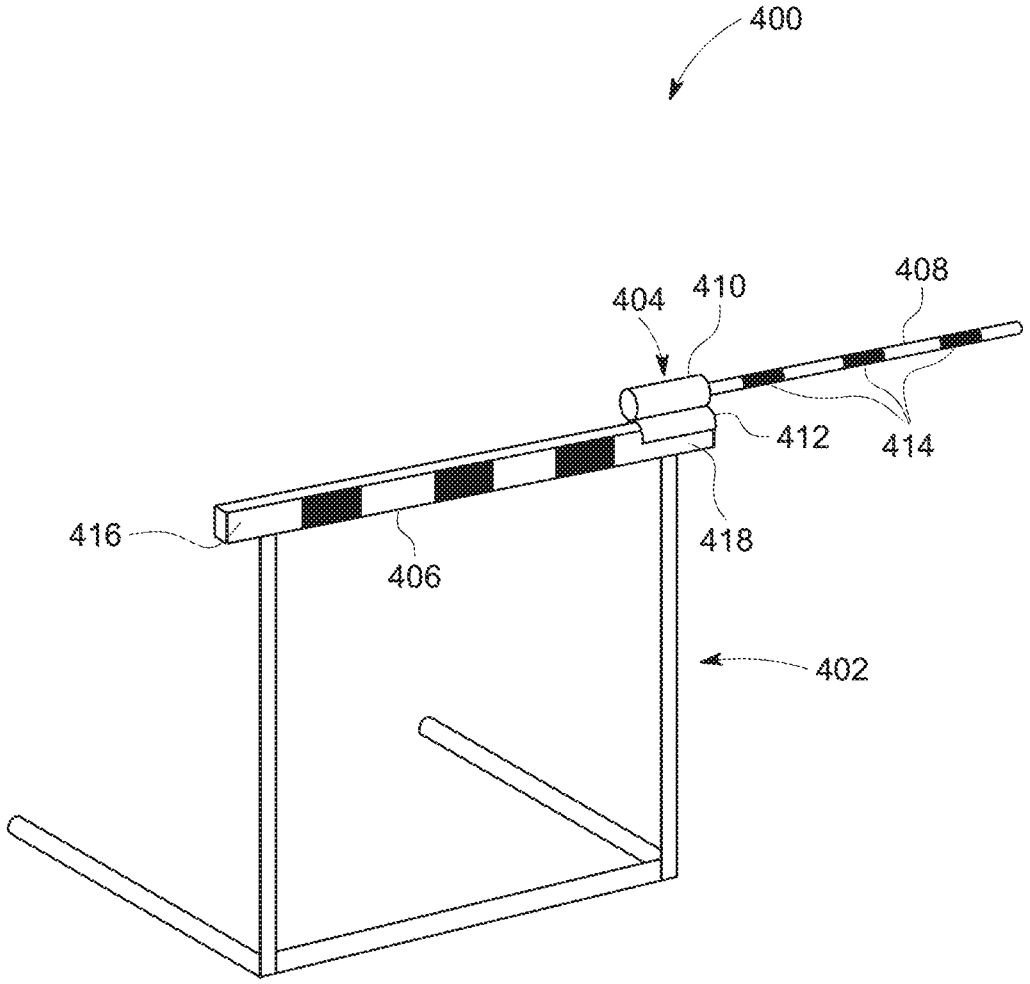
FIG. 4 shows a perspective view of a hurdle assist system comprising a hurdle, a coupler, and a flexible rod according to a preferred embodiment.

FIG. 4 depicts a perspective view of a hurdle assist system 400 which includes a hurdle 402, a coupler 404 having a flexible tubular lower section 412 and a flexible tubular upper section 410, and a flexible rod 408. The hurdle 402 includes a barrier section 406 which has a first distal end 418 and a second distal end 416. The flexible tubular lower section 412 of the coupler 404 is removably coupled with the first distal end 418. In an alternative embodiment, the flexible tubular lower section 412 of the coupler 404 may be removably coupled with the second distal end 416. As Described above, the flexible tubular lower section 412 and the flexible tubular upper section 410 of the coupler 404 include slits (not visible in this figure) which are used to removably couple the flexible tubular lower section 412 with the first distal end 418 of the barrier section 406, and to slidably removably couple the flexible rod 408 with the flexible tubular upper section 410, respectively. In a preferred embodiment, the flexible rod 408 include indicators in the form of three segments 414 which are painted with a different color than the color of the flexible rod 408. In yet another embodiment, the flexible rod 408 includes light emitting diodes (LEDs) as indicators.

Figure 5A:
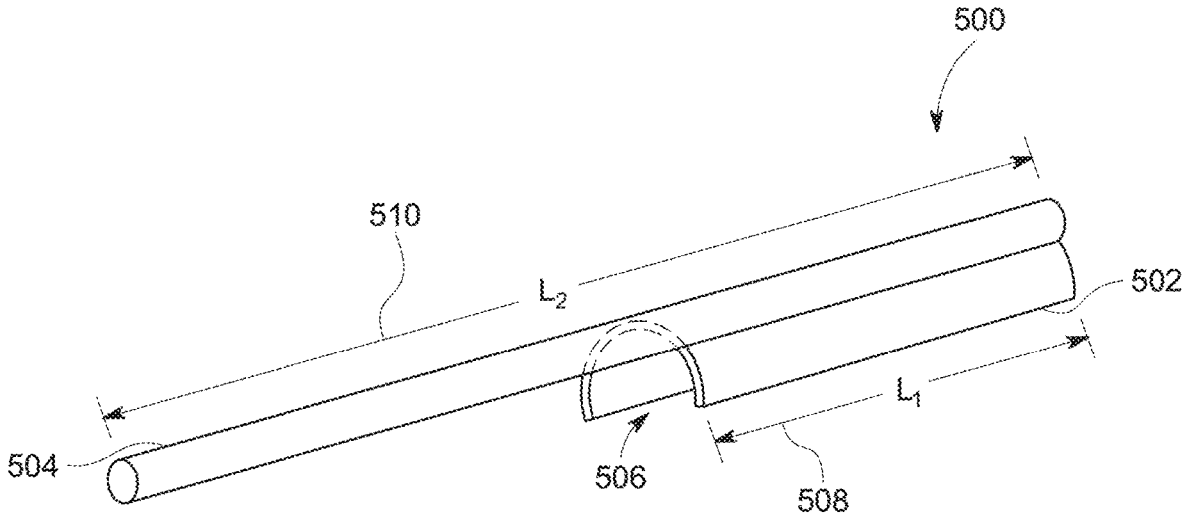
FIG. 5A shows a perspective view of a hurdle barrier extender having a flexible tubular lower section having a first length and a flexible upper section having a second length that is greater than the first length according to a preferred embodiment.

FIG. 5A depicts a perspective view of a hurdle barrier extender 500 having a flexible tubular lower section 502 having, a first length $L_1$ at 508 and a flexible upper section 504 having a second length $L_2$ at 510 that is greater than the first length $L_1$ at 508. According to this preferred embodiment, the length $L_1$ at 508 is equal to 3 inches and the length $L_2$ at 510 is equal to 28 inches. As can be seen, the flexible upper section 504 of the extender 500 is one piece and can be used instead of having a flexible tubular upper section and a flexible rod, as described above. According to this preferred embodiment, both the flexible tubular lower section 502 and the flexible upper section 504 are of circular cross sections. In a preferred embodiment, an outer diameter of the flexible tubular lower section 502 is equal to 0.75 inches and an outer diameter of the flexible upper section 504 is equal to 0.50 inches. In a preferred embodiment, both the flexible tubular lower section 502 and the flexible upper section 504 are made from plastic material such as polyvinyl chloride.

Figure 5B:
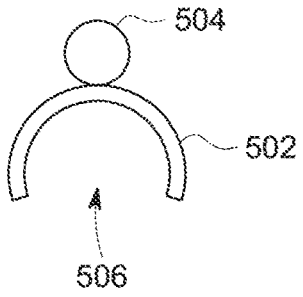
FIG. 5B shows a front view of the hurdle barrier extender shown in FIG. 5A.

FIG. 5B depicts a front view of the extender 500 shown in FIG. 5A. The flexible tubular lower section 502 includes a slit 506 but the flexible upper section 504 is a solid pipe. The slit 506 enables the flexible tubular lower section 502 to easily and removably couple with a barrier section of a hurdle, such as the barrier section 114 of the hurdle 112 shown in FIG. 1B. In a preferred embodiment, the slit 506 is cut along the entire length of the flexible tubular lower section 502. In alternative embodiments, the slit 506 is cut along a partial length of the flexible tubular lower section 502. In a preferred embodiment, the slit 506 is produced by removing 145 degrees of the circle, along the length $L_1$ at 508 of the flexible tubular lower section 502. In alternative embodiments, the cross sections of the flexible tubular lower section 502 and the flexible upper section 504 may be of different profiles, such as having elliptical cross sections.

The foregoing explanations, descriptions, illustrations, examples, and discussions have been set forth to assist the reader with understanding this invention and further to demonstrate the utility and novelty of it and are by no means restrictive of the scope of the invention. It is the following claims, including all equivalents, which are intended to define the scope of this invention.

What is claimed is:

1. A running hurdle assist system, comprising:

(a) a running hurdle comprising a barrier section, said barrier section comprising a barrier length;

(b) a coupler comprising a flexible tubular lower section, said flexible tubular lower section comprising a first length and a first slit along the first length, and a flexible tubular upper section, said flexible tubular upper section comprising a second length and a second slit along the second length; and (c) a flexible rod comprising a third length;

wherein the flexible tubular lower section is removably coupled with the barrier section along one of a first distal end and a second distal end of the barrier section; and wherein the flexible rod is slidably removably coupled with the flexible upper section.

2. The system of claim 1, wherein the flexible tubular lower section comprises one of a circular cross section and a rectangular cross-section.

3. The system of claim 1, wherein the flexible tubular upper section comprises one of a circular cross section and a rectangular cross-section.

4. The system of claim 1, wherein the first length is equal to the second length.

5. The system of claim 1, wherein at least one of the flexible tubular lower section and the flexible tubular upper section is made from plastic.

6. The coupler of claim 1, wherein the flexible rod further comprises one or more indicators along the third length.

7. The coupler of claim 6, wherein the one or more indicators comprise one or more segments of the flexible rod painted with a different color than a color of the flexible rod.

8. A method of assisting a hurdler during practice, comprising:

(a) providing a running hurdle, said running hurdle comprising a barrier section, said barrier section comprising a barrier length;

(b) providing a coupler, said coupler comprising a flexible tubular lower section, said flexible tubular lower section comprising a first length and a first slit along the first length, and a flexible tubular upper section, said flexible tubular upper section comprising a second length and a second slit along the second length; and (c) providing a flexible rod, said flexible rod comprising a third length;

wherein the flexible tubular lower section is removably coupled with the barrier section along one of a first distal end and a second distal end of the barrier section; and (d) slidably removably coupling the flexible rod with the flexible upper section.

* * * * *